US011146878B2

(12) United States Patent
Sha

(10) Patent No.: US 11,146,878 B2
(45) Date of Patent: Oct. 12, 2021

(54) HEARING DEVICE

(71) Applicant: BOCO INC., Tokyo (JP)

(72) Inventor: Hataaki Sha, Tokyo (JP)

(73) Assignee: BOCO INC., Tokyo (JP)

( * ) Notice: Subject to any disclaimer, the term of this patent is extended or adjusted under 35 U.S.C. 154(b) by 0 days.

(21) Appl. No.: 16/961,792

(22) PCT Filed: Nov. 8, 2018

(86) PCT No.: PCT/JP2018/041442
§ 371 (c)(1),
(2) Date: Jul. 13, 2020

(87) PCT Pub. No.: WO2019/142461
PCT Pub. Date: Jul. 25, 2019

(65) Prior Publication Data

US 2021/0076121 A1 Mar. 11, 2021

(30) Foreign Application Priority Data

Jan. 16, 2018 (JP) ..... JP2018-004831

(51) Int. Cl.
*H04R 1/10* (2006.01)

(52) U.S. Cl.
CPC ..... *H04R 1/1016* (2013.01); *H04R 2460/13* (2013.01)

(58) Field of Classification Search
CPC ..... H04R 1/1016; H04R 2460/13
(Continued)

(56) References Cited

U.S. PATENT DOCUMENTS 3,030,455 A * 4/1962 Pearson ..... H04R 25/606 381/326
2002/0039427 A1* 4/2002 Whitwell ..... H04R 1/1091 381/312

(Continued)

FOREIGN PATENT DOCUMENTS

JP S56042223 U 4/1981
JP H0262199 A 3/1990

(Continued)

OTHER PUBLICATIONS

International Search Report issued in PCT Patent Application No. PCT/JP2018/041442 dated Jan. 29, 2019.

(Continued)

*Primary Examiner* — Sean H Nguyen
(74) *Attorney, Agent, or Firm* — Marshall, Gerstein & Borun LLP

(57) ABSTRACT

A holder extends from a part fixed to a housing and curves in substantially S-shape. A portion that extends from the housing and significantly curves for the first time serves as an ear-hanging part. The ear-hanging part is a portion that is hanged on an upper part of an auricle of a user. A portion that curves from the ear-hanging part so as to protrude toward a transmitting surface serves as a holding part. That is, the holding part is a portion that is formed at a position opposed to the transmitting surface and that is closest to the transmitting surface. A grasping part that can be curved, as needed, so as to be slightly distanced away from the transmitting surface is provided further toward the end from the holding part. The grasping part is a portion at which the user grasps the holder, the grasping part being so held allowing for easy attachment to and detachment from the auricle.

5 Claims, 10 Drawing Sheets

(58) Field of Classification Search
USPC ..... 381/151
See application file for complete search history.

(56) References Cited

U.S. PATENT DOCUMENTS

| | | | | |
|---|---|---|---|---|
| 2009/0290730 | A1* | 11/2009 | Fukuda | H04R 1/1091 381/151 |
| 2013/0136279 | A1 | 5/2013 | Brown et al. | |
| 2014/0098983 | A1* | 4/2014 | Clow | H04R 1/10 381/375 |
| 2017/0238096 | A1* | 8/2017 | Nakagawa | H04R 5/04 381/310 |
| 2019/0373357 | A1* | 12/2019 | Khaleghimeybodi | G06F 30/00 |

FOREIGN PATENT DOCUMENTS

| | | | |
|---|---|---|---|
| JP | 2001-320790 | A | 11/2001 |
| JP | 2004-64457 | A | 2/2004 |

OTHER PUBLICATIONS

Office Action issued in Japanese Patent Application No. 2018-004831 dated May 17, 2018.

* cited by examiner

HEARING DEVICE

TECHNICAL FIELD OF THE INVENTION

The present invention relates to a hearing device employing bone conduction that enables a hearer to perceive sound by conducting vibrations to bones.

BACKGROUND OF THE INVENTION

As a means of listening to or hearing music or conversations, devices such as headphones and earphones (hereinafter, hearing devices) have been widely used conventionally. Such hearing devices employ either air vibrations or bone conduction. Those using air vibrations use a mechanism in which a sound source that is input as electric signals is converted into air vibrations, which are then transmitted to and vibrate an eardrum, and the vibrations of the eardrum travel inside the ear through a middle ear so that information of the sound is transmitted to and perceived by a brain.

A hearing device employing bone conduction, on the other hand, converts acoustic signals that are input as electric signals into mechanical vibrations and conducts these vibrations from an appropriate position to bones so that the hearer can perceive the sound as bone-conducted sound through vibrations. Unlike headphones and earphones, a user does not have to insert such a bone conduction hearing device into his/her earhole. Thus, it is safer for the user since he/she can hear unblocked surrounding sound while wearing the device. Also, since bone conduction does not use eardrum vibrations, even people with hearing difficulties would be able to perceive sounds through bone conduction. Thus, hearing aids and the like employing bone conduction have been advanced (Japanese Unexamined Patent Application Publication No. 1990-62199 (JP-A-1990-62199), for example).

Such a hearing device employing bone conduction enables hearing of sounds by contacting its vibrating part at an appropriate position. Examples of the appropriate position are parts like temples or mastoid.

However, the inventor of the present invention has found after earnest research that sounds with larger volume can be obtained with less power by conducting sounds to cartilage of an auricle, instead of the skull. Also, the inventor has found that, for people with hearing difficulties for example, there are parts of the auricle where the person can hear more easily. For example, it has been found that some people find it difficult to hear the sounds if the vibrations are conducted from the front of the auricle to the cartilage of the auricle, yet it is easier to hear if the vibrations are conducted from the back of the auricle.

In such a case, it is preferable that the vibrations from the vibrating part of the hearing device are conducted to the cartilage efficiently within a small space of the rear side of the auricle. However, an especially unique structure may increase weight and cost of the device, which is not preferable.

SUMMARY OF THE INVENTION

The present invention was made in view of such problems. Its object is to provide a hearing device that can fit efficiently to a rear side of an auricle, excels in handling performance, and can be easily worn or removed.

To achieve the above object, the present invention is a hearing device employing bone conduction. The hearing device includes a vibrating part, a housing, and a holder. The vibrating part converts acoustic electric signals into vibrations and outputs the vibrations. The housing accommodates the vibrating part. The holder is joined to the housing and is for fitting the housing to an ear. The housing is provided with a transmitting surface that comes into contact with a rear side of the ear for transmission of vibrations. The holder includes a holding part opposite to the transmitting surface. The holding part on a front side of the ear and the transmitting surface on the rear side of the ear can interpose the ear. The holder is an arm-shaped elastic member extending from the housing. An ear-hanging part that hangs on an upper part of the ear is composed as one body with the holding part that protrudes from the ear-hanging part toward the transmitting surface.

A grasping part at which a user grasps may be formed at an end side of the holder.

A separating part may be formed between the housing and the holder.

It is preferable that a connecting part is provided in proximity of an end part of the holder and the holder can be attached to and detached from the housing by means of the connecting part.

A cushion material that is softer than a main body of the holder may be disposed at the grasping part.

According to the present invention, the hearing device can be attached to an ear so as to allow the transmitting surface of vibrations to be in contact only with the rear side of the auricle. Thus, vibrations can be transmitted efficiently to cartilage of the auricle without being released to a skull where transmission efficiency of vibration is worse. For this reason, a larger sound volume can be obtained with less power. Since the transmitting surface is in contact with the rear side of the auricle, the present invention is particularly applicable to users who find it difficult to hear if the device is attached to the front side of the auricle.

Also, the holder is in an arm shape and is curved so as to protrude toward the transmitting surface. This allows the holding part to hold a hollow part on the front side of the auricle with certainty. Also, the ear-hanging part provided can suppress falling of the hearing device even if holding force of the holding part is small. That is, by providing both the ear-hanging part and the holding part, the ear-hanging part is only required to simply receive the weight of the hearing device on the upper part of the auricle, and the holding part is required only to make the transmitting surface in close contact with the back of the auricle. Thus, strong holding force is not required and strain on the auricle can be reduced.

Furthermore, forming the grasping part at which the user grasps at an end side of the holder facilitates wearing and removing of the device.

Also, forming the separating part between the housing, which accommodates the vibration part, and the holder, which is fixed to the housing, suppresses transmission of vibrations from the housing to the holder, and thus sound leakage or the like can be suppressed.

Also, if the holder and the housing are detachable, the holder can be exchanged with the others with different sizes. Thus, the user can wear the device having a holder of an appropriate size and shape that fits the size of his/her ear.

Also, disposing the soft cushion material at the holding part can reduce the pressure the ear receives and can also adjust a gap between the holding part and the transmitting surface.

The present invention can provide a hearing device that can fit efficiently to a rear side of an auricle, excels in handling performance, and can be easily worn or removed.

DESCRIPTION OF SOME EMBODIMENTS

Figure 1:
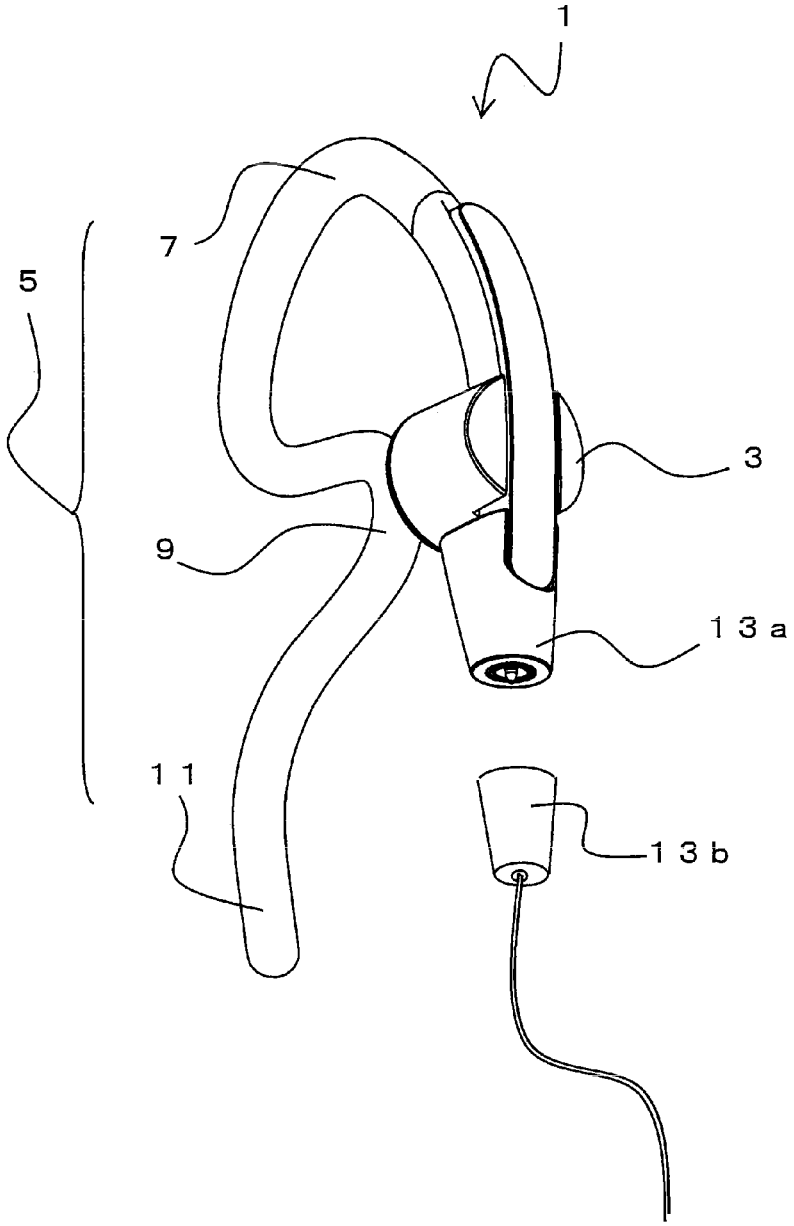
FIG. 1 is a perspective view of a hearing device 1.
Figure 2:
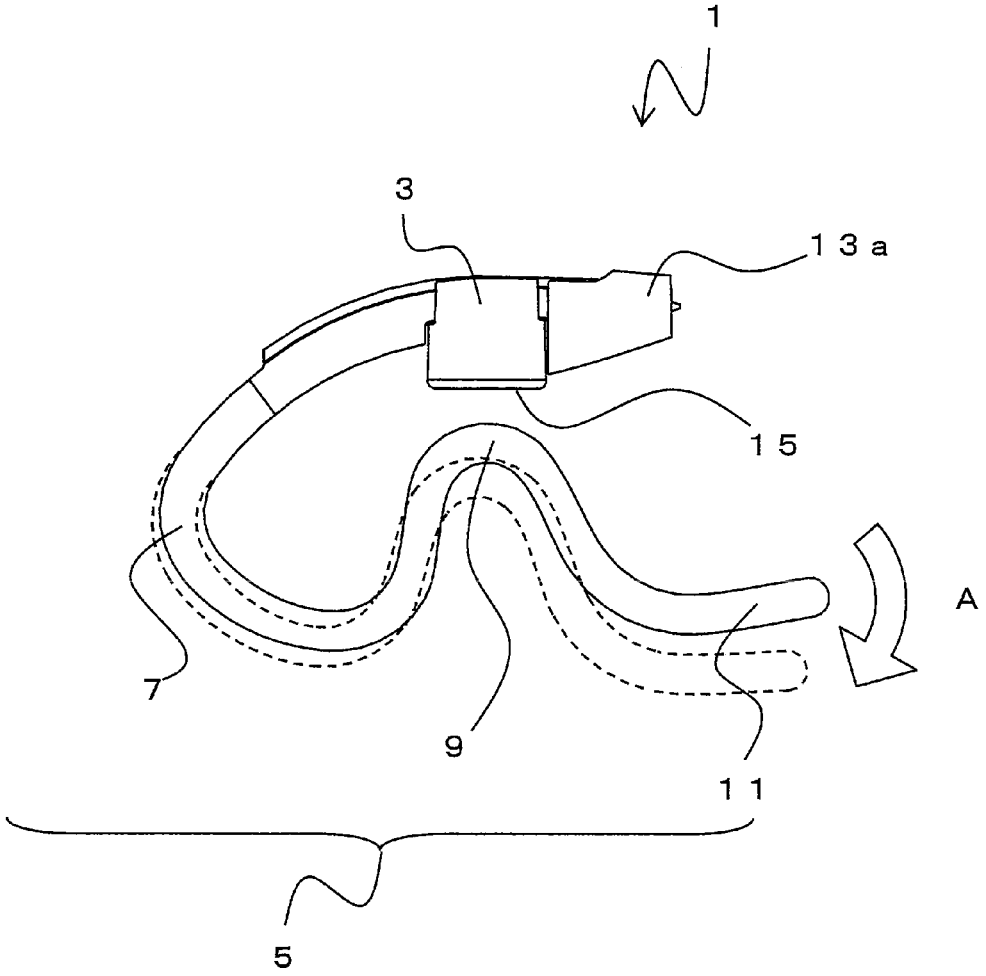
FIG. 2 is a side view of the hearing device 1.

Hereinafter, some embodiments of the present invention will be described with reference to the accompanying drawings. FIG. 1 is a perspective view of a hearing device 1, FIG. 2 is a side view of the hearing device 1, FIGS. 3*a* to 3*d* are a plan view, a bottom view, a front view, and a rear view of the hearing device 1, respectively. The hearing device 1 is mainly composed of a housing 3, a holder 5, a connector 13*a*, and so forth.

The housing 3 accommodates a vibrating part. The vibrating part converts acoustic signals that are input as electric signals into mechanical vibrations and vibrates. Converting acoustic electric signals into vibrations means converting acoustic electric signals that are input externally into mechanical vibrations, and, for example, the acoustic electric signals vibrate a diaphragm or the like so as to be converted into mechanical vibrations that are then transmitted to bones. In the present invention, a type of vibrating system of the vibrating part is not particularly limited as long as the acoustic electric signals can be converted into mechanical vibrations, and any types of conventional methods such as piezoelectric, electromagnetic, or super-magnetostrictive methods are applicable.

Vibrations obtained in this way are transmitted from a transmitting surface 15, which is one of surfaces of the housing 3, to a bone of a user. In the present invention, it is preferable that the vibrations are transmitted to a rear side of an auricle of the user. In this way, as mentioned above, the device is applicable to the users who find it difficult to hear if the device is attached to the front side of the auricle, and, in addition, cables and the like that are to be connected to the housing 3 can be arranged and laid on the rear side of the auricle.

Here, to dispose the housing 3 on the rear side of the auricle and to suppress transmission of vibrations to a skull, it is preferable that the transmitting surface of the housing 3 is in contact only with the rear side of the auricle. Thus, a size of the housing 3 is preferably small enough to be disposed on a small space on the rear side of the auricle. For example, using a vibrator having a diameter of 10 mm or less can reduce the size of the housing 3.

The transmitting surface 15 of the housing 3 directly touches the skin of a wearer and thus the transmitting surface 15 is made of a material that is not painful or uncomfortable when fitted. Examples are synthetic resin and synthetic rubber, and, although not limited to the above, the material is preferably soft and flexible since the material touches a rear part of the auricle.

The holder 5 is fixed to the housing 3. The holder 5 is an elastic member in an arm shape (a curved rod shape), and one of end part sides thereof is connected with the connector 13*a*. As shown in FIG. 1, the connector 13*a* is connected with a sound source side connector 13*b* or the like. That is, the hearing device 1 is detachable with a sound source.

Figure 3A:
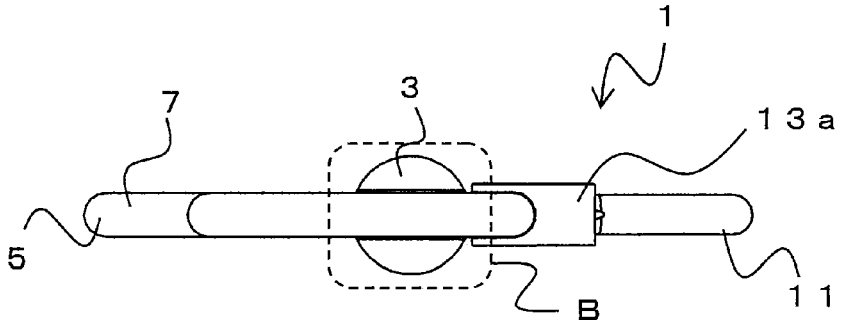
FIG. 3*a* is a plan view of the hearing device 1.
Figure 3B:
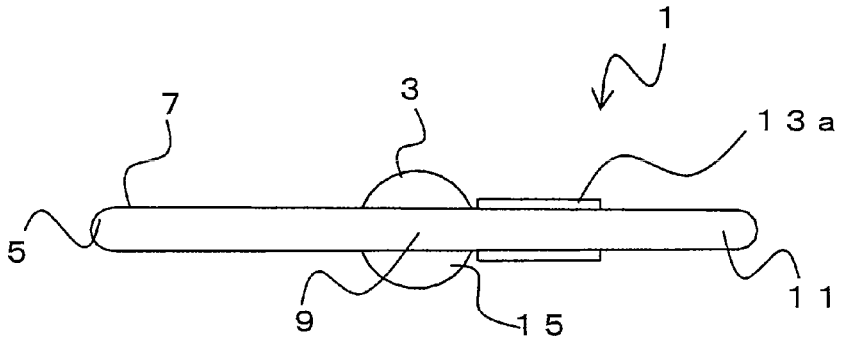
FIG. 3*b* is a bottom view of the hearing device 1.
Figure 3C:
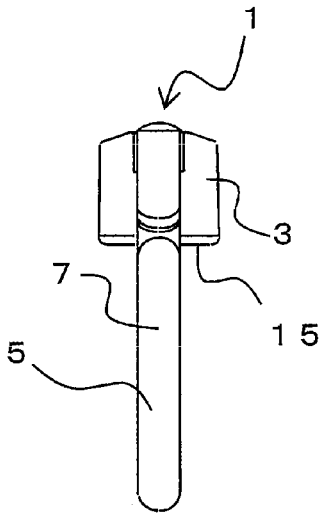
FIG. 3*c* is a front view of the hearing device 1.
Figure 3D:
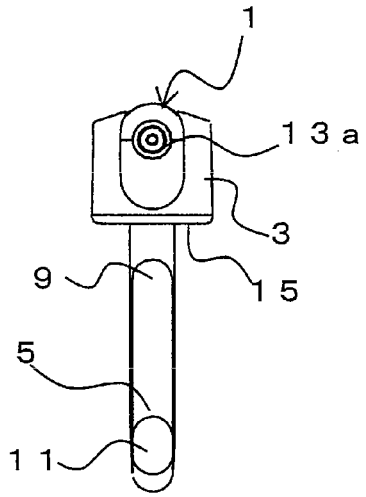
FIG. 3*d* is a rear view of the hearing device 1.
Figure 4A:
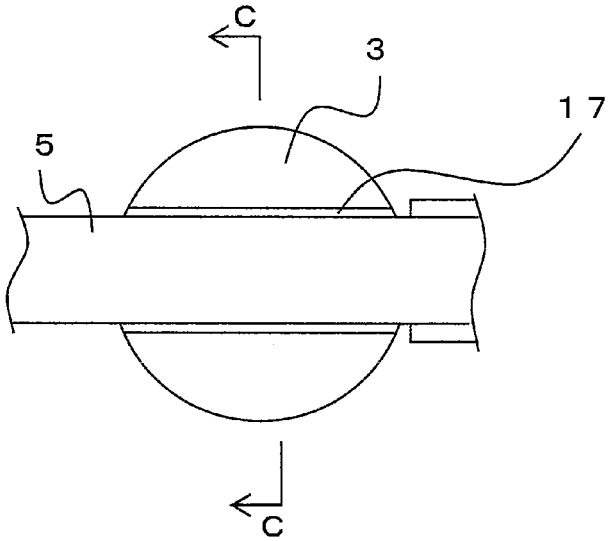
FIG. 4*a* is an enlarged view of B section in FIG. 3*a*.
Figure 4B:
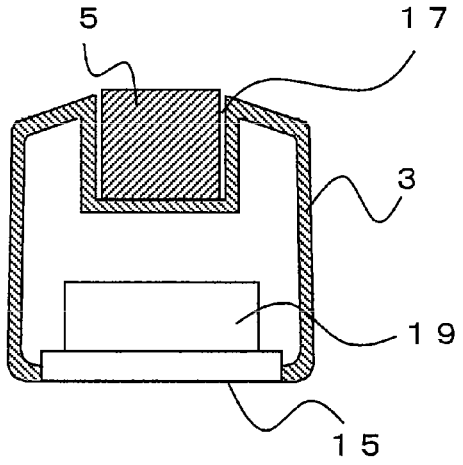
FIG. 4*b* is a cross sectional view taken along C-C line in FIG. 4*a*.

FIG. 4*a* is an enlarged view of B section in FIG. 3*a*, and FIG. 4*b* is a cross sectional view taken along C-C line in FIG. 4*a*. As mentioned above, a vibrating part 19 is disposed inside the housing 3. The inner structure of the housing 3 is illustrated in a schematic view in which illustrations of a circuit board and wirings etc. are omitted.

A part of the holder 5 is joined to the housing 3. Here, the holder 5 is disposed being embedded in an upper surface of the housing 3. In this state, a separating part 17 is formed between a side surface of the holder 5 and the housing 3. That is, a clearance is formed between the side surface of the holder 5 and the housing 3, and thus the side surface of the holder 5 is not in contact with the housing 3. Thus, the holder 5 is in contact with the housing 3 only via a lower surface of the holder 5.

By making a contact area between the holder 5 and the housing 3 smaller in this way, transmission of vibrations from the housing 3 to the holder 5 can be suppressed. This can suppress sound leakage. At this time, if the holder 5 protrudes from the upper surface of the housing 3, overall height is increased, which impairs the fitting to the back of the auricle. Thus, to further reduce the size of the device, a part of the holder 5 is embedded into the housing 3 and, in addition, the separating part 17 is formed so that the compact hearing device 1 with little sound leakage can be obtained.

The contact area between the holder 5 and the housing 3 is preferably, for example, one-third or less of a projected area of a planar view of the housing 3. That is, a fixing surface between the holder 5 and the housing 3 is one-third or less of the projected area so that transmission of vibrations from the housing 3 to the holder 5 can be suppressed. Furthermore, the separating part may be formed on the fixing surface between the holder 5 and the housing 3. That is, instead of contacting an entire lower surface of the holder 5 with the housing 3, a part of the lower surface of the holder 5 may be raised. For example, if a contacting part between the holder 5 and the housing 3 is in a linear shape having a thickness (in a vertical direction in FIG. 4*a*) of 0.5 mm or more, the holder 5 and the housing 3 are not separated from each other and the housing 3 can be kept being attached to the auricle.

Also, a buffer member absorbing vibrations may be disposed between the vibrating part 19 and the housing 3 to prevent transmission of vibrations from the vibrating part 19 to the housing 3.

As shown in FIG. 2, the holder 5 extends from the fixing part with the housing 3 and curves in a substantially S shape. The first big curve of the holder 5 extending from the housing 3 corresponds to an ear-hanging part 7. The ear-hanging part 7 is a part that hangs on an upper part of the auricle of the user. A part that curves from the ear-hanging part 7 so as to protrude toward the transmitting surface 15 corresponds to a holding part 9. That is, the holding part 9 is a part that is formed at an opposite position from the transmitting surface 15 and that is closest to the transmitting surface 15. The curved part may be replaced with a straight rib shape or a circular shaped protrusion.

A grasping part 11 gradually curving so as to be slightly away from the transmitting surface 15 is provided further toward a tip end from the holding part 9 as necessary. The grasping part 11 is a part at which the user grasps the holder 5. The grasping part 11 is away from the ear-hanging part 7, and the entire holder 5 elastically deforms easily. Thus, when the user holds the grasping part 11 to put the device on to or remove the device from the auricle, the holder 5 (the proximity of the ear-hanging part 7 in particular) elastically deforms and the user can easily put the device on to or remove the device from the auricle. The ear-hanging part 7, the holding part 9, and the grasping part 11 have circular cross sections, for example.

The shape of the holder 5 is not limited to the illustrated example. Any other shapes and structures may be applied as long as the holding part 9 is formed at an opposite position from the transmitting surface 15. However, if the ear-hanging part 7, the holding part 9, and the grasping part 11 are integrated in one body made of a curved elastic member as shown in the drawings, the structure is simple and it is easy to elastically deform the parts (an arrow A in FIG. 2), which facilitates putting the device on and removing the device from the auricle.

Figure 5:
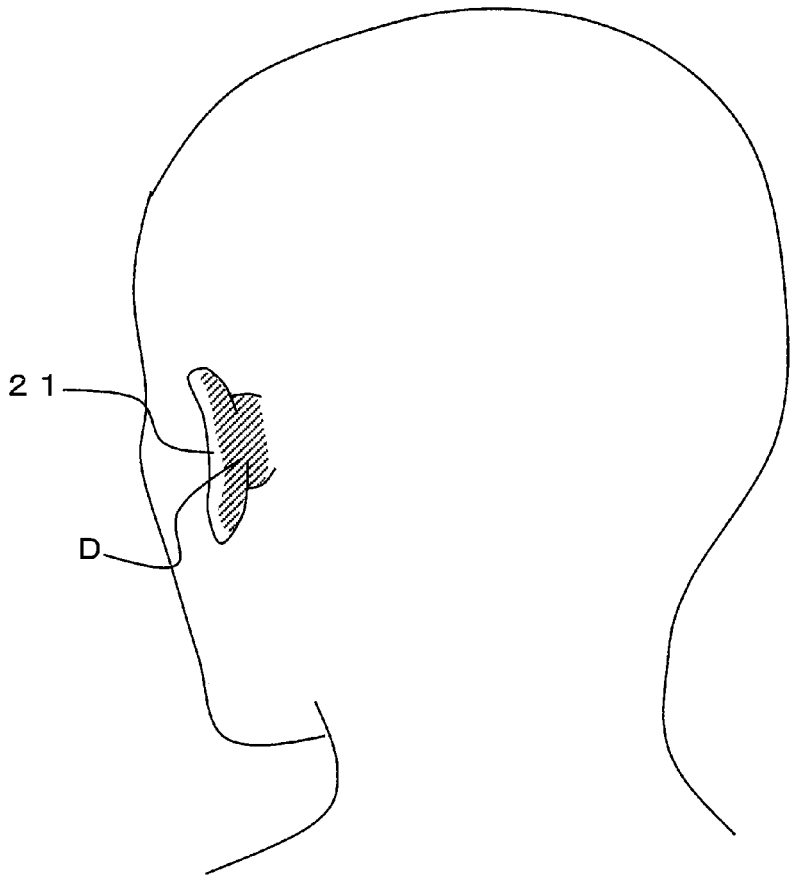
FIG. 5 is a view showing a sound transmission region of an auricle 21 of a user.
Figure 6:
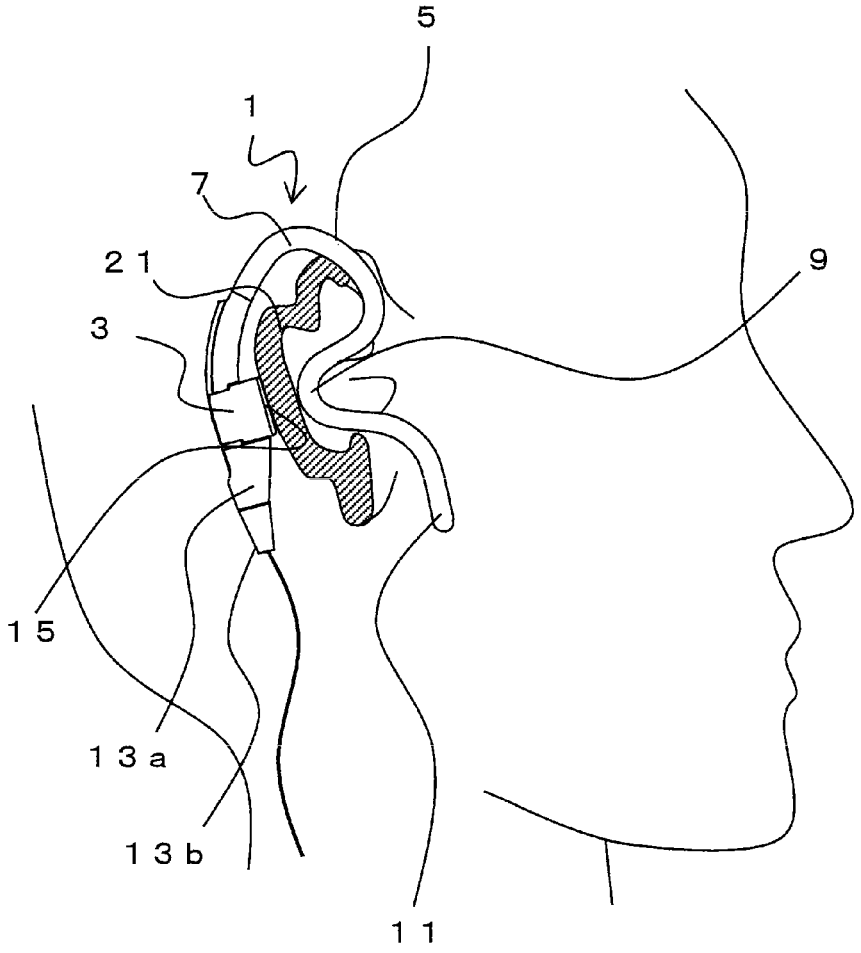
FIG. 6 is a schematic view showing a state in which the hearing device 1 is fit to the auricle 21 of the user.

Next, a method for using the hearing device 1 will be described. FIG. 5 is a view showing a region on the rear side of the user's auricle 21 that comes into contact with the transmitting surface 15, and FIG. 6 is a schematic view showing a state in which the hearing device 1 is fit to the auricle 21 (a partial cross sectional view of the auricle 21). As mentioned above, the hearing device 1 according to the present invention is preferably in contact with the rear side of the auricle 21 (a region D in FIG. 5). At this time, it is preferable that the transmitting surface 15 of the housing 3 is not in contact with the skull and most of the vibrations from the transmitting surface 15 transmit only to the auricle 21. For example, even if the skull and the hearing device 1 are to touch, it is preferable that a surface of the holder 5 is in contact with the skull side.

As shown in FIG. 6, when the hearing device 1 is fit to the auricle 21, the transmitting surface 15 comes into contact with a rear surface side of the auricle 21. Also, the holder 5 extends to an upper part of the auricle 21, and the ear-hanging part 7 is hanged on the upper part of the auricle 21. Furthermore, the holding part 9 of the holder 5 curves on the front side of the auricle 21 toward the transmitting surface 15 side, and the holding part 9 on the front side of the auricle 21 and the transmitting surface 15 on the rear side of the auricle 21 interpose the auricle 21. Moreover, the grasping part 11 extends downward from the holding part 9 to the outside of the auricle 21.

Fitting the hearing device 1 as above allows the vibrations from the transmitting surface 15 to efficiently transmit to cartilage of the auricle 21. The transmitting surface 15 may be positioned anywhere on the rear side of the auricle 21, although a part above the earlobe is preferable. The user can feel the fit when wearing the hearing device 1 if the holding part 9 fits into a hollow portion on the front face of the auricle 21 (a hollow portion above the earlobe).

As above, according to the present embodiment, the vibrations transmit to the rear side of the auricle 21, and thus, compared to a case in which the vibrations are transmitted to the skull or the like, sound can be heard efficiently with less output. Thus, the compact hearing device 1 can be obtained. In other words, making the hearing device 1 compact in this way enables the hearing device 1 to be in contact only with the rear side of the auricle 21.

Also, the holder 5 has both the ear-hanging part 7 and the holding part 9 formed and thus the strain to the wearer's auricle 21 is small. For fitting a hearing device to an auricle, there is also a clip type method using springs or gears, for example. In such a method, a clip interposes the auricle 21 to support and hold the hearing device to the auricle 21 and this requires fairly strong holding force to prevent falling. On the other hand, a fitting method in which the device is hanged only on the upper part of the auricle 21 is unable to make the transmitting surface come into close contact with the skin, which leads to unstable sounds and sound leakage.

In the present embodiment, the ear-hanging part 7 serves to prevent the device from falling off the auricle and the holding part 9 serves to make the transmitting surface 15 come into close contact with the skin. Thus, each part has to play only a small function required and the strain to the auricle 21 is small. Having both the ear-hanging part 7 and the holding part 9 formed in this way as well as forming the ear-hanging part 7 and the holding part 9 as one body in an arm shape can make the structure simple, reduce the strain to the auricle 21, and transmit the vibrations to cartilage of the auricle 21 with certainty.

Also, forming the grasping part 11 extending from the holding part 9 allows the user to wear and remove the hearing device 1 easily. For example, when removing the hearing device 1, lifting the grasping part 11 with a little force can deform the holder 5 easily so that the hearing device 1 can be removed from the auricle 21. At this time, only the elastic deformation of the holder 5 is required to put the device on or remove the device from the auricle 21 and thus the operation is easy.

Figure 7:
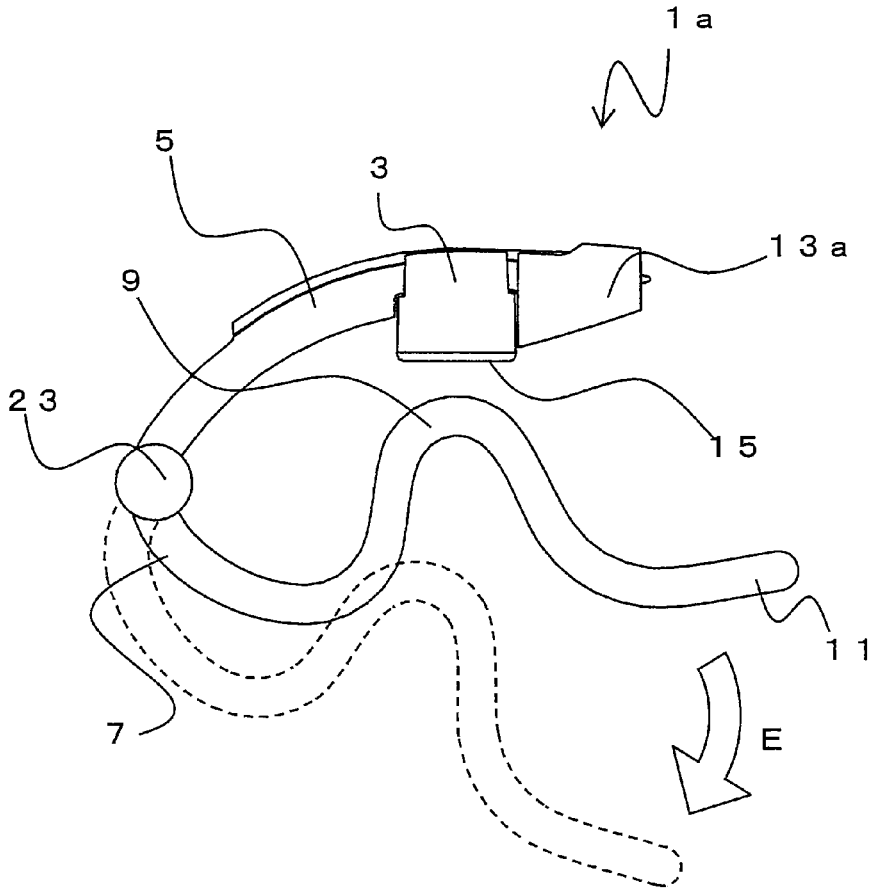
FIG. 7 is a side view of a hearing device 1*a*.

As shown in a hearing device 1*a* in FIG. 7, a rotary part 23 may be formed at a part of the holder 5. In such a case, in addition to the elastic deformation of the holder 5, a rotation of the rotary part 23 enables wearing or removing of the hearing device 1*a*. For example, if a gear can hold the rotary part 23 at a predetermined angle, the holding force of the holding part 9 can be adjusted. Also, when removing, opening the holder 5 by grasping the grasping part 11 (an arrow E in the drawing) can remove the hearing device 1*a* easily.

Figure 8:
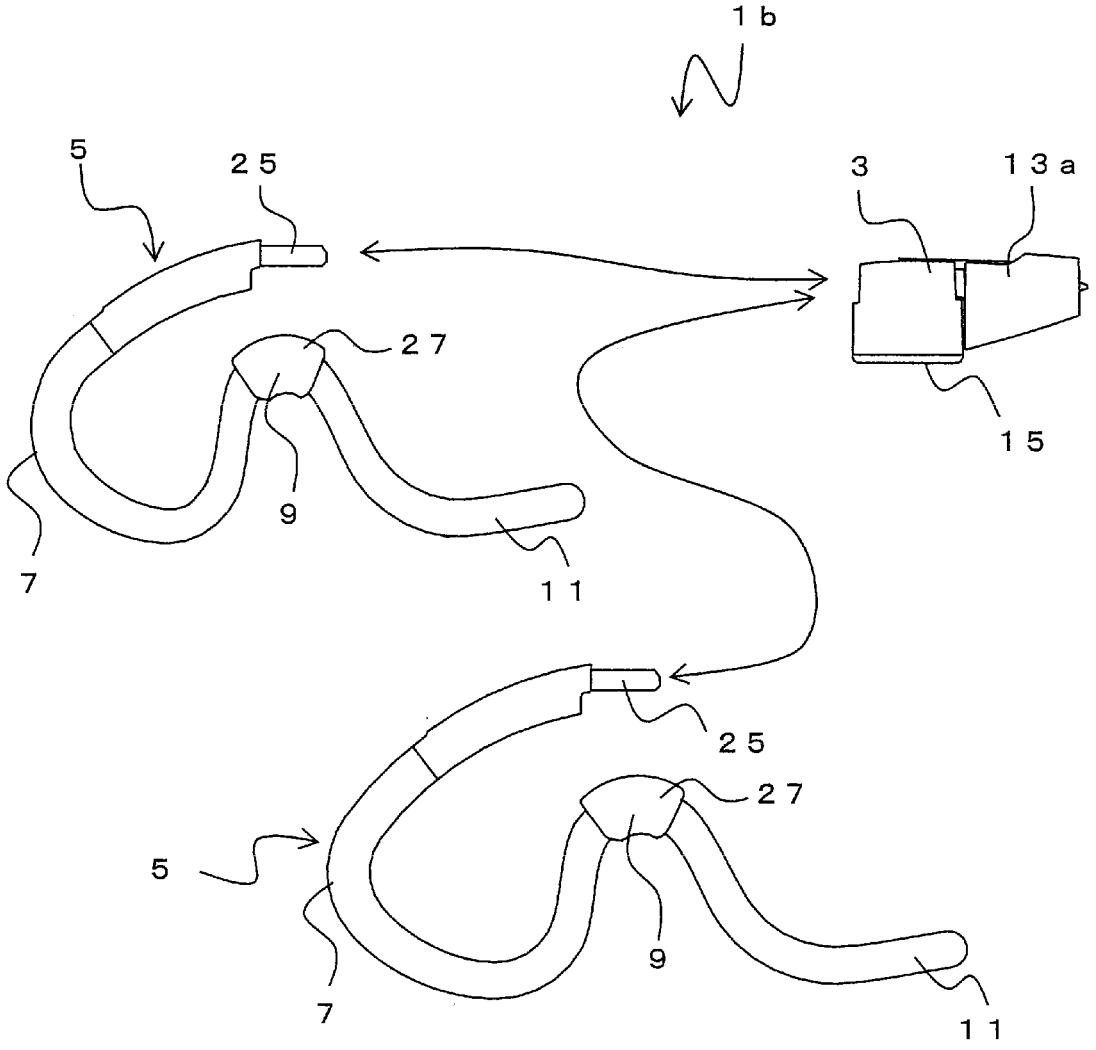
FIG. 8 is a side view of a hearing device 1*b*.

Also, as shown in a hearing device 1*b* in FIG. 8, the holder 5 may be detachable from the housing 3. In such a case, a connecting part 25 is formed in proximity of an end part of the holder 5. The connecting part 25 may be a pin or an engaging claw, for example. In this way, the holder 5 can be freely replaced with the ones with different sizes, depending on the size and shape of the user's ear. A surface of the connecting part 25 may be formed of soft resin to suppress the vibrations of the housing 3 from transmitting to the holder 5.

Also, a cushion material 27, which is softer than the main body of the holder 5, may be disposed at the holding part 9 of the holder 5. The main body of the holder 5 is formed of a material such as hard resin that can keep its shape. Whereas the holder part 9 is formed of a member that is softer than the main body of the holder 5, such as silicone rubber. The holding part 9 is a part that is pushed against the ear directly, and thus the cushion material 27 can serve to reduce the pressure that the ear receives from the holding part 9 and to adjust a space between the holding part 9 and the transmitting surface 15. The cushion material 27 may be detachable from the holding part 9.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

For example, needless to say, the hearing device 1 according to the present invention can be used by being fitted to one ear or to both ears. Also, the hearing device 1 according to the present invention can serve as a microphone by attaching a mike, or may be used as a hearing aid by attaching a sound collector, and can be used in various devices and equipment employing bone conduction. Also, although the holder 5 is fitted from above the ear, the holder 5 may be fitted to the ear from under the ear depending on ear shapes, interposing the ear with the holding part 9 and the transmitting surface 15. In such a case, it is possible to make the holder part 5 smaller, which can improve its design.

What is claimed is:

1. A hearing device employing bone conduction, the hearing device comprising:

a vibrating part that converts acoustic electric signals into vibrations and outputs the vibrations;

a housing that accommodates the vibrating part; and a holder for fitting the housing to an ear, the holder being joined to the housing, wherein:

the housing is provided with a transmitting surface that comes into contact with only a rear side of the ear to transmit vibrations, the holder comprises a holding part opposite to the transmitting surface, the holding part on a front side of the ear and the transmitting surface on the rear side of the ear can interpose the ear and the holder is an arm-shaped elastic member extending from the housing, and an ear-hanging part that hangs on an upper par of the ear is composed as one body with the holding part that protrudes from the ear-hanging part toward the transmitting surface.

2. The hearing device according to claim 1, wherein a grasping part at which a user grasps is formed at an end side of the holder.

3. The hearing device according to claim 2, wherein a cushion material that is softer than a main body of the holder is disposed at the grasping part.

4. The hearing device according to claim 1, wherein a separating part is formed between the housing and the holder.

5. The hearing device according to claim 1, wherein a connecting part is provided in proximity of an end part of the holder and the holder can be attached to and detached from the housing by means of the connecting part.

* * * * *